US005852264A

United States Patent [19]

Muller

[11] Patent Number: 5,852,264

[45] Date of Patent: Dec. 22, 1998

[54] METHOD AND APPARTUS FOR THE MEASUREMENT OF THE LOAD IN AN ELEVATOR

[75] Inventor: Jurgen Muller, Ebikon, Switzerland

[73] Assignee: Inventio Ag, Hergiswil, Switzerland

[21] Appl. No.: 683,220

[22] Filed: Jul. 18, 1996

[30] Foreign Application Priority Data

Jul. 26, 1995 [CH] Switzerland ..... 02187/95

[51] Int. Cl.[6] ..... B66B 1/04

[52] U.S. Cl. ..... 187/292; 187/281; 187/392

[58] Field of Search ..... 187/281, 292, 187/392; 177/147, 225

[56] References Cited

U.S. PATENT DOCUMENTS

| | | | |
|---|---|---|---|
| 4,053,742 | 10/1977 | Halase, III et al. | 364/567 |
| 4,460,066 | 7/1984 | Ohta | 187/29 |
| 4,573,542 | 3/1986 | Schlegal et al. | 177/132 |
| 4,793,442 | 12/1988 | Heckler et al. | 187/115 |
| 5,149,922 | 9/1992 | Kondou | 187/131 |
| 5,306,879 | 4/1994 | Pearson | 187/131 |
| 5,435,416 | 7/1995 | Siikonen et al. | 187/392 |
| 5,531,294 | 7/1996 | Burton et al. | 187/292 |

FOREIGN PATENT DOCUMENTS

| | | |
|---|---|---|
| 0528188 | 2/1993 | European Pat. Off. . |
| 3042968 | 7/1982 | Germany . |

OTHER PUBLICATIONS

1. An International Search Report.

*Primary Examiner*—Robert Nappi

*Attorney, Agent, or Firm*—Greenblum & Bernstein, P.L.C.

[57] ABSTRACT

A method and apparatus for measuring a load in an elevator cage supported by a carrying frame. The elevator cage movable relative to the carrying frame and to an elevator shaft. The elevator cage may rest on spring elements, which bear on the carrying frame. A belt, which may guided by a pair of deflecting rollers, may be mechanically coupled with the elevator cage. The movement of the elevator cage may be transmitted to the belt, which drives a pulse generator coupled to a first deflecting roller. When the load within the elevator cage changes, the spring elements may be compressed to a greater or lesser extent according to their spring characteristic. Accordingly, the elevator cage may move relative to the carrying frame, and the movement may be detected by the pulse generator and translated into a travel signal. An evaluating unit may be utilized to convert the travel signal into a load magnitude for influencing a motor current.

23 Claims, 3 Drawing Sheets

METHOD AND APPARTUS FOR THE MEASUREMENT OF THE LOAD IN AN ELEVATOR

CROSS-REFERENCE OF RELATED APPLICATIONS

The present invention is based upon Swiss patent application Ser. No. 02 187/95-6 filed on Jul. 26, 1995, the disclosure of which is incorporated by reference herein in its entirety.

BACKGROUND OF THE INVENTION

1. Field of the Invention

The present invention is directed to a method and apparatus for the measurement of a load in an elevator cage supported by spring elements mounted to a carrying frame. The carrying frame may be movable in an elevator shaft by a hoist cable guided over a drive pulley. A controlled motor may drive the drive pulley and execute travel commands of an elevator control.

2. Discussion of Background Information

An elevator cage with load-measuring equipment has been discussed in U.S. Pat. No. 4,573,542. The cage base of the elevator cage is supported by spring elements on horizontally extending bracket limbs. The vertically extending bracket limbs are screwed to a base carrier of a carrying frame. A strain gauge is fastened at each of the upper and lower sides of the horizontally extending limb. Four brackets are provided and arranged at the four corners of the base carrier. The strain gauges are connected together into a bridge circuit which is connected with an amplifier. The amplifier is fastened at the base carrier below the elevator cage at the door side.

A disadvantage of the above-described apparatus is the expensive construction and assembly of the brackets with the strain gauges at the base carrier of the carrying frame. A further disadvantage is that appreciable adjustment operations are necessary for the bridge circuit at the amplifier. These systems are generally also expensive in manufacture and in upkeep.

SUMMARY OF THE INVENTION

The present invention solves the above-noted disadvantages of the known apparatus to precisely detect the load in an elevator cage with devices that are already present in an elevator system.

Accordingly, one aspect of the present invention is directed to a method for the measurement of the load in an elevator cage supported in a carrying frame by spring elements and movable in an elevator shaft by a hoist cable guided over a drive pulley. A motor control drives the drive pulley and executes travel commands received from an elevator control. The method may include moving the elevator cage relative to the carrying frame and relative to an elevator shaft by passenger loading and unloading, converting the movement of the elevator cage into a travel signal, and forming a first load magnitude from the travel signal, the first load magnitude influencing a motor current controlled by the motor control.

According to a particular feature of the present invention, when the elevator cage is positioned at a stopping place, the method may include detecting the travel signal before and after the passengers have loaded and unloaded, and forming the first load magnitude based upon the detected travel signal.

According to another feature of the present invention, the method may include forming a second load magnitude from a motor current controlled by the motor control, and forming a third load magnitude from a sum of the first load magnitude and the second load magnitude. The third load magnitude may influence the motor current.

According to another feature of the present invention, the method may include closing cage doors associated with the elevator cage and forming the third load magnitude after the closing of the cage doors. The second load magnitude may be formed during a preceding journey and based on the motor current for achieving an intended speed for the elevator cage.

Another aspect of the present invention may be directed to an apparatus for the measurement of the load in an elevator cage supported in a carrying frame by spring elements and movable in an elevator shaft by a hoist cable guided over a drive pulley. A motor control drives the drive pulley and executes travel commands received from an elevator control. The apparatus may include a signal transmitter for measuring a movement of the elevator cage relative to the carrying frame and an elevator shaft due to passenger loading and unloading, a travel signal generator for generating a travel signal corresponding to the movement of the elevator cage relative to the carrying frame and the elevator shaft, and an evaluating unit, said evaluating unit comprising a first converter for ascertaining a first load magnitude corresponding to the travel signal. The first load magnitude may influence a motor current controlled by the motor control.

According to a further feature of the present invention, the evaluating unit may also include a second converter for ascertaining a second load magnitude corresponding to said motor current, and an adder for determining a third load magnitude formed from a sum of the first load magnitude and the second load magnitude. The third load magnitude influencing the motor current controlled by the motor control.

Another aspect of the present invention may be directed to a method for the measurement of a load in an elevator cage. The elevator cage may be mounted for movement relative to a carrying frame and to an elevator shaft and moved relative to the carrying frame and elevator shaft by load changes within the elevator cage. The method may include evaluating a first signal corresponding to the movement of the elevator cage relative to the elevator shaft, evaluating a second signal corresponding to a cage load, evaluating a third signal, based upon the first signal and the second signal, and transmitting the third signal to a motor control to control a motor current.

According to another feature of the present invention, the first signal evaluating step may include determining whether the elevator cage has arrived at a stopping place, and prior to opening a set of cage doors, reading a first position of the elevator cage, relative to the elevator shaft, from a travel transmitter. Upon issuance of a command to close the set of cage doors, the method may include reading a second position of the elevator cage, relative to the elevator shaft, from the travel transmitter, and evaluating the first signal based upon a difference between the first position and the second position.

According to yet another feature of the present invention, the second signal evaluating step may include determining whether the set of cage doors is closed, determining a motor current at a target speed of the elevator cage, and evaluating the second signal based upon the determined motor current.

According to still another feature of the present invention, the method may further include, after the transmitting step, replacing the evaluated third signal with a subsequently evaluated second signal.

According to yet another feature of the present invention, the method may further include transmitting the evaluated third signal to an elevator control device. The method may also include transmitting travel commands from the elevator control device to the motor control.

According to another feature of the present invention, the method may further include determining, within the motor control, a travel curve based upon the travel commands and upon a travel signal indicative of a position of the elevator cage relative to the elevator shaft.

According to another aspect of the present invention, the first signal evaluating step may be performed by a first converter. Further, the first converter may include at least one of a look-up table and a mathematical formula.

According to another aspect of the present invention, the second signal evaluating step may be performed by a second converter. Further, the second converter may include at least one of a look-up table and a mathematical formula.

Another aspect of the present invention may be directed to an apparatus for the measurement of a load in an elevator cage. The elevator cage mounted for movement relative to a carrying frame and to an elevator shaft and moved relative to the carrying frame and elevator shaft by load changes within the elevator cage. The apparatus may include a device for evaluating a first signal corresponding to the movement of the elevator cage relative to the elevator shaft, a device for evaluating a second signal corresponding to a cage load, a device for evaluating a third signal, based upon the first signal and the second signal, and a device for transmitting the third signal to a motor control to control a motor current.

According to another feature of the present invention, the first signal evaluating device may include a device for determining whether the elevator cage has arrived at a stopping place, a device for reading a first position of the elevator cage, relative to the elevator shaft, from a travel transmitter, prior to opening a set of cage doors, and a device for reading a second position of the elevator cage, relative to the elevator shaft, from the travel transmitter, upon issuance of a command to close the set of cage doors. The first signal may be based upon a difference between the first position and the second position.

According to another feature of the present invention, the second signal evaluating device may include a device for determining whether the set of cage doors is closed, a device for determining a motor current at a target speed of the elevator cage, and a device for evaluating the second signal based upon the determined motor current.

According to a further feature of the present invention, the apparatus may further include a device for replacing the evaluated third signal with a subsequently evaluated second signal after the third signal is transmitted to the motor control.

According to still another feature of the present invention, the first signal evaluating device may include a converter.

According to still another feature of the present invention, the second signal evaluating device may include a converter.

Further advantages may be achieved by the present invention and may be realized in simplifying the cage base and the carrying frame. The arrangement of the present invention makes a load measurement possible for reasons of costs even in the case of cheap elevator systems.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENT

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
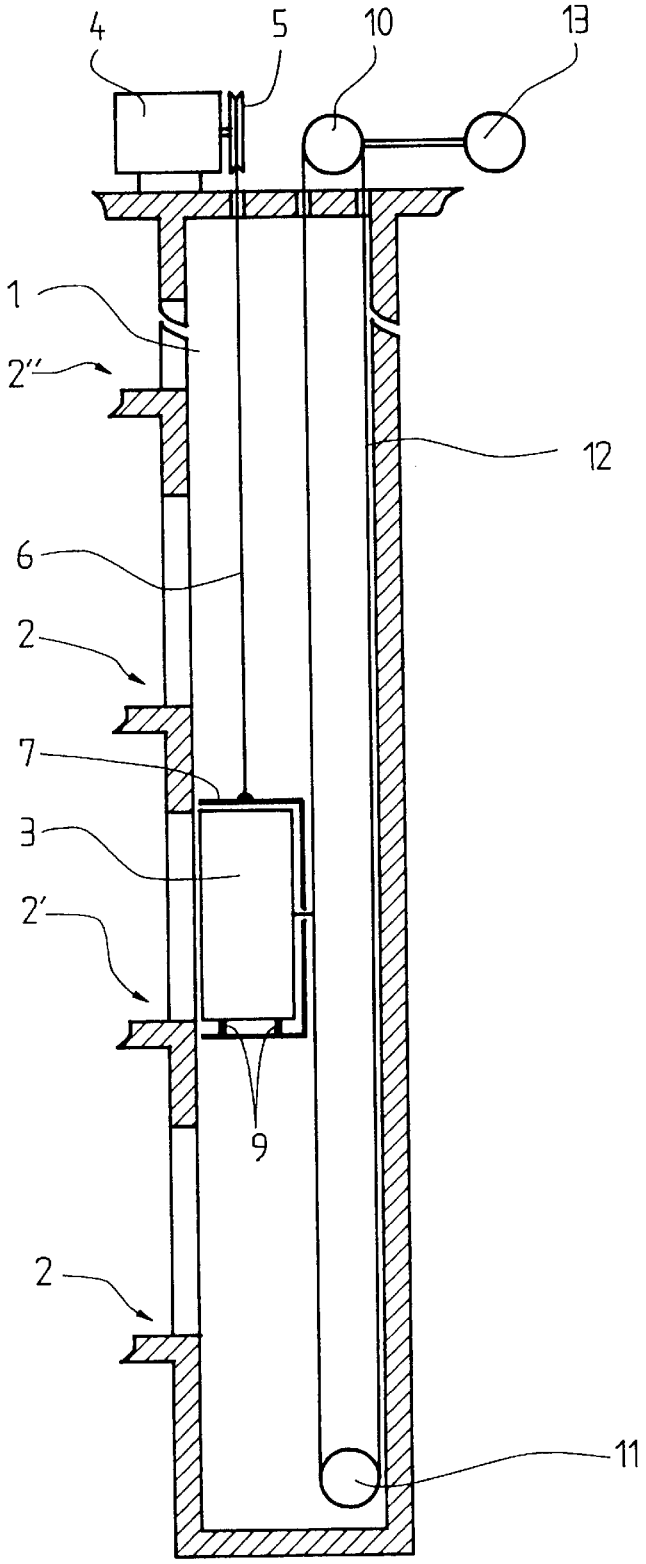
FIG. 1 shows an elevator shaft with an elevator cage and a travel transmitter.
Figure 2:
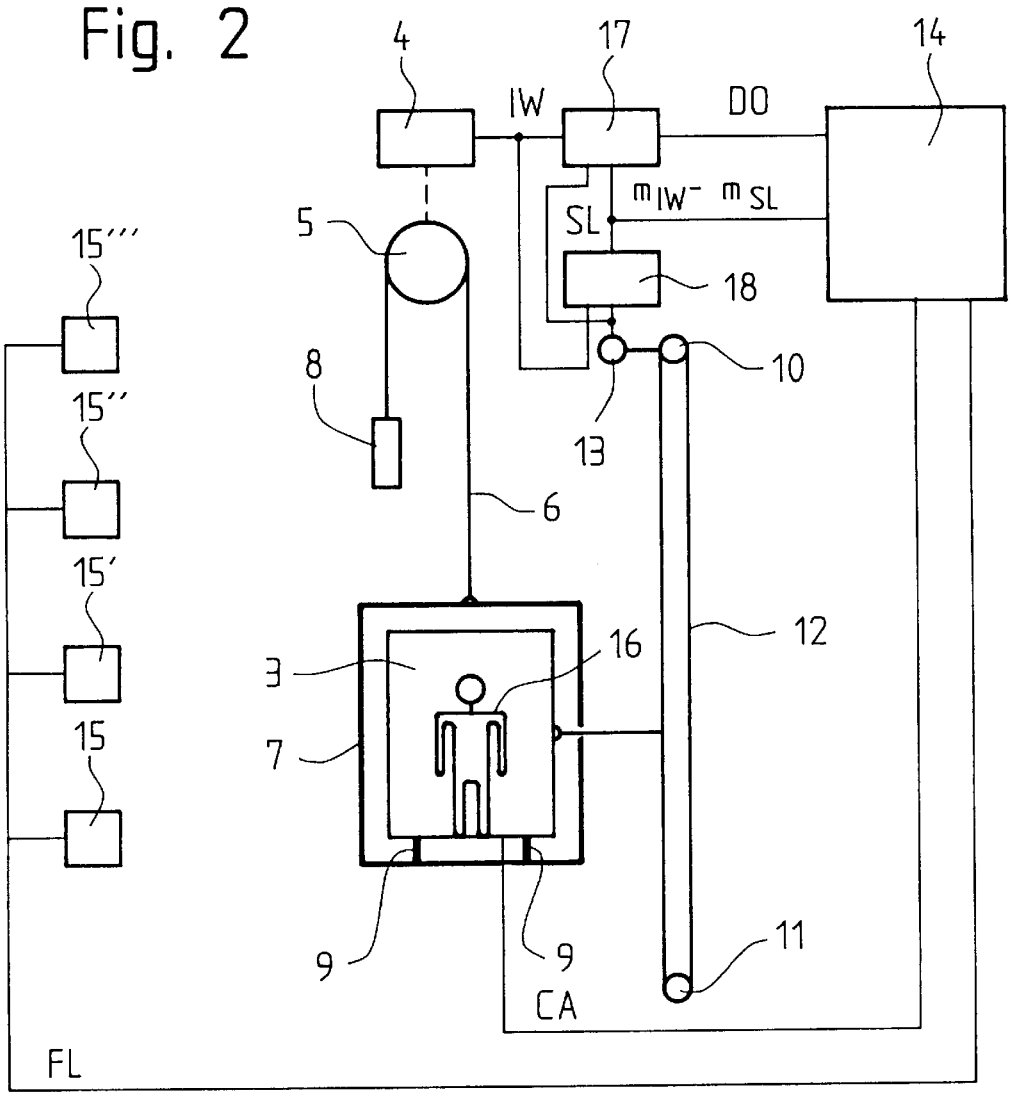
FIG. 2 shows an elevator system with the equipment according to the invention for the measurement of the load in the elevator cage.

FIGS. 1 and 2 show an elevator shaft 1 in which an elevator cage 3 is movable to stopping places 2, 2', 2". A motor 4 drives a hoist cable 6 over a drive pulley 5. A carrying frame 7 may be arranged at one end of hoist cable 6 and a counterweight 8 may be arranged at the opposite end. Elevator cage 3 may rest on spring elements 9 mounted on carrying frame 7. A belt 12 may be guided by a first deflecting roller 10 and a second deflecting roller 11, and may be mechanically coupled with elevator cage 3. Vertical movements of the elevator cage 3, relative to the elevator shaft 1, may be imparted by the motor 4, and such movements may be transmitted to a pulse generator 13 coupled to the first deflecting roller 10 through belt 12. Thus, any vertical movement of the elevator cage 2 may be converted into electrical pulses by the pulse generator 13. Motor 4 moves elevator cage 3 between a plurality of stopping places 2, 2', 2". Additional vertical movements of the elevator cage 3 relative to elevator shift may occur due to expansion of the hoist cable 6 and/or to load changes in elevator cage 3. Due to load variations in the elevator cage 3, spring elements 9 may be compressed to a greater or lesser extent according to their spring characteristics. Accordingly, elevator cage 3 may move relative to carrying frame 7 and may move relative to elevator shaft 1. The load changes effecting the relative position of elevator cage 3 with respect to elevator shaft 1 may be detected by pulse generator 13 and translated into electrical pulses. Pulse generator 13, belt 12 and deflecting rollers 10 and 11 may be components of a travel transmitter which may be installed in elevator systems to detect the exact position of elevator cage 3 in elevator shaft 1. Pulse generator 13 may alternatively be driven by a speed limiter (not shown).

In an alternative to the embodiment shown in FIG. 1, motor 4 may be mounted to carrying frame 7. Motor 4 may be, e.g., a linear motor drive or a friction wheel drive without a cable. Pulse transmitter 13 may alternatively be positioned at elevator cage 3. In this alternative, belt 12 and deflecting rollers 10 and 11 may be dispensed so that pulse transmitter 13 may be driven by, e.g., a friction wheel rolling along on a guide rail.

FIG. 2 shows an elevator system including equipment for measuring the load in the elevator cage. An elevator control 14 generates travel commands DO in response to story calls FL entered at transmitters 15, 15', 15", 15'" of respective stopping places 2, 2', 2", 2'" and in response to cage calls CA entered by passengers 16 in elevator cage 3. Pulse generator 13 may generate travel signals SL which correspond to the instantaneous position of the elevator cage 3 in the elevator shaft 1. The travel commands DO may be transmitted from elevator control 14 to a motor control 17 and the travel signals SL may be transmitted from pulse generator 13 to motor control 17. Because the present system includes a closed loop drive control system, motor control 17, e.g., a converter, may determine a travel curve (reference speed) for elevator cage 3 and include a speed feedback signal, e.g., tachometer generating signal. The travel curve may be a voltage unit to be utilized by the executing software and may be based upon travel commands DO and travel signal SL. A cage acceleration target (reference) value, a nominal cage speed target value, and of cage delay target value may be ascertained by the travel curve. An evaluating unit 18 may also be included for ascertaining load magnitudes. A motor current signal IW may be fed from motor control 17 to evaluating unit 18. Evaluating unit 18 may also receive travel signal SL from pulse generator 13. The load magnitudes ascertained by evaluating unit 18 may be forwarded to motor control 17.

Figure 3:
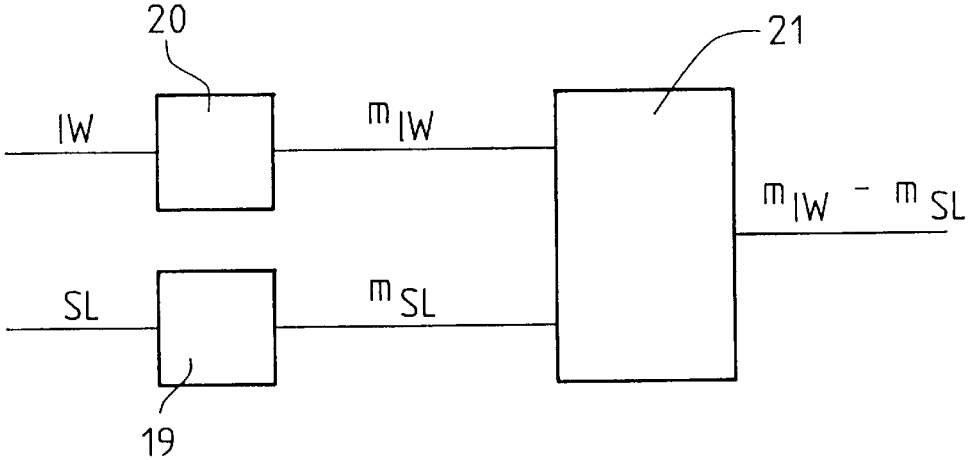
FIG. 3 shows a block schematic diagram of an evaluating unit.

FIG. 3 shows the operation of evaluating unit 18. Travel signal SL may be fed to a first converter 19 which may include, e.g., a mathematical formula. When the elevator cage 3 stops at a next stopping place, e.g., stopping place 2, travel signal SL may be converted into a first load magnitude $m_{SL}$. First load magnitude $m_{SL}$ corresponds to the movement of the elevator cage 3 relative to the elevator shaft 1. Thus, calculation of the first load magnitude $m_{SL}$ is well within the purview of the ordinarily skilled artisan when the spring rate and distance are known. Motor current IW may be fed to a second converter 20, which may include, e.g., a look-up table or mathematical formula. Motor current IW, which may relate to the target speed of the elevator cage 3, may be converted into a second load magnitude $m_{IW}$, which corresponds to a cage load. Thus, calculation of the second load magnitude $m_{IW}$ is well within the purview of the ordinarily skilled artisan when the motor current is known. Second load magnitude $m_{IW}$ may serve as new load reference. For example, assuming a stop of elevator cage 3 and subsequent unloading and/or new loading, second load magnitude $m_{IW}$, as the reference, and first load magnitude $m_{SL}$, corresponding to the new load in elevator cage 3, may be combined by an adder 21 to produce a third load magnitude $m_{IW}-m_{SL}$. Third load magnitude $m_{IW}-m_{SL}$ may influence motor current IW which may be controlled by motor control 17. Concurrently, the third load magnitude $m_{IW}-m_{SL}$ may be evaluated by elevator control 14. Elevator control 14 may adjust allocation procedures depending upon the load currently in elevator cage 3. For example, elevator control 14 may refuse to accept cage calls CA or story calls FL when elevator cage 3 is determined to be full.

As an alternative to calculating the first and second load magnitudes, the present invention may include a first look-up table in which for a given value of travel signal SL, a corresponding first load magnitude $m_{SL}$ is selected. The present invention may also include a second look-up table in which for a given value of motor current, a corresponding second load magnitude $m_{IW}$ is selected. For example, the first look-up table may be generated by loading the elevator cage with known loads to measure the corresponding deflection of the elevator cage floor. The second look-up table may be generated by running the motor at a predetermined current and measuring the corresponding torque. Thereafter, the first and second look-up tables may be stored in, e.g., motor control 17.

Figure 4:
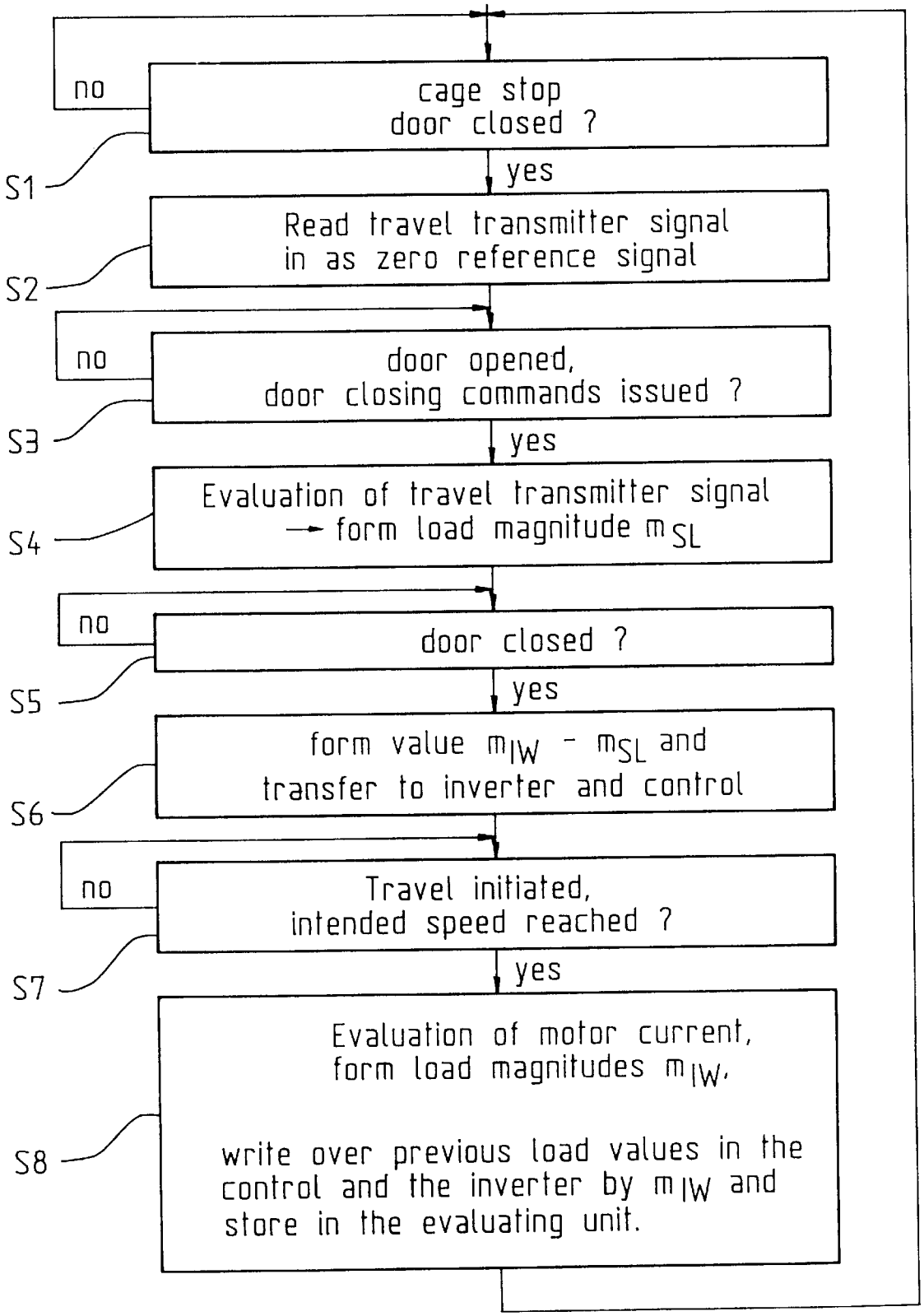
FIG. 4 shows a flow diagram, according to which the evaluating unit operates.

FIG. 4 shows an exemplary flow diagram of the operation of evaluating unit 18. In step S1, it is determined whether elevator cage 3 is standing at a stopping place and whether the doors are closed. If it is determined that the elevator has arrived at a stopping place and the doors have not yet opened, travel signal SL may be read by the evaluating unit from pulse generator 13 and stored as a reference signal, in step S2. However, if it is determined that the elevator is not at a stopping place and/or the elevator doors are not shut, step S1 is repeated until all conditions of step S1 have been satisfied. At step S3, it is to be determined whether the doors are open and whether a door closing command has been issued. If both conditions are not satisfied, step S3 may be repeated as necessary until an affirmative result is found. After it has been ascertained that the doors of elevator cage 3 have been opened and the door closing command has taken place, step S4 may evaluate travel signal SL to calculate and store first load magnitude $M_{SL}$ from the difference between the reference signal of step S2 and the currently evaluated travel signal SL. In step S5, it is determined whether the doors have been closed again. If it is determined in step S5 that the door is not closed, step S5 may be repeated until the condition is satisfied. When the doors are closed, the third load magnitude $m_{IW}-M_{SL}$ may be ascertained in step S6. Second load magnitude $m_{IW}$ may be formed during the elevator journey that preceded the current step; first load magnitude $m_{SL}$ was formed in step S4. Third load magnitude $m_{IW}-m_{SL}$ may be transmitted to elevator control 14 and to motor control 17. In step S7, the speed of elevator cage 3 may be monitored upon departing from the stopping place until elevator cage 3 has reached its target speed. In step S8, second load magnitude $m_{IW}$ may be calculated and stored in accordance with instantaneous motor current IW. Third load magnitude $m_{IW}-m_{SL}$, transmitted to elevator control 14 and to motor control 17 and stored in step S6, may be written over by second load magnitude $m_{IW}$. Elevator cage 3 may then travel to the next stop, e.g., stopping place 2" with second load magnitude $m_{IW}$ influencing motor current IW under the control of motor control 17.

In an alternative embodiment in which a motor control is utilized in which motor current is not evaluated, motor current may be controlled merely by the first load magnitude $m_{SL}$. A reference signal may be produced in this embodiment when elevator cage 3 is empty. Then any load change due to load magnitude $m_{SL}$ of the preceding journey may be added for each stop.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A method for the measurement of the load in an elevator cage supported in a carrying frame by spring elements, the cage being movable with respect to the frame and the cage and frame together are movable in an elevator shaft by a hoist cable guided over a drive pulley, a motor control drives the drive pulley and executes travel commands received from an elevator control, said method comprising:

moving the elevator cage relative to the carrying frame and relative to an elevator shaft by passenger loading and unloading measuring the movement of the cage relative to the shaft;

converting the measured movement of the elevator cage into a travel signal; and forming a first load magnitude from the travel signal, the first load magnitude influencing a motor current controlled by the motor control.

2. The method according to claim 1, wherein when the elevator cage is positioned at a stopping place, detecting the travel signal before and after the passengers have loaded and unloaded; and forming the first load magnitude based upon the detected travel signal.

3. The method according to claim 2, said method further comprising:

forming a second load magnitude from a motor current controlled by the motor control; and forming a third load magnitude from a sum of the first load magnitude and the second load magnitude, the third load magnitude influencing the motor current.

4. The method according to claim 3, further comprising:

closing cage doors associated with the elevator cage;

forming the third load magnitude after the closing of the cage doors, the second load magnitude formed during a preceding journey and based on the motor current for achieving an intended speed for the elevator cage.

5. An apparatus for the measurement of the load in an elevator cage supported in a carrying frame by spring elements, the cage being movable with respect to the frame and the cage and frame together are movable in an elevator shaft by a hoist cable guided over a drive pulley, a motor control drives the drive pulley and executes travel commands received from an elevator control, said apparatus comprising:

a signal transmitter for measuring a movement of the elevator cage relative to an elevator shaft due to passenger loading and unloading, a travel signal generator for generating a travel signal corresponding to the movement of the elevator cage relative to the elevator shaft, an evaluating unit, said evaluating unit comprising a first converter for ascertaining a first load magnitude corresponding to the travel signal, said first load magnitude influencing a motor current controlled by the motor control.

6. The apparatus according to claim 5, said evaluating unit further comprising:

a second converter for ascertaining a second load magnitude corresponding to said motor current; and an adder for determining a third load magnitude formed from a sum of said first load magnitude and said second load magnitude, said third load magnitude influencing said motor current controlled by the motor control.

7. A method for the measurement of a load in an elevator cage, the elevator cage mounted for movement relative to a carrying frame and to an elevator shaft and moved relative to the carrying frame and elevator shaft by load changes within the elevator cage, said method comprising:

evaluating a first signal corresponding to the movement of the elevator cage relative to the elevator shaft;

evaluating a second signal corresponding to a cage load;

evaluating a third signal, based upon the first signal and the second signal;

transmitting the third signal to a motor control to control a motor current.

8. The method according to claim 7, the first signal evaluating step comprising:

determining whether the elevator cage has arrived at a stopping place;

prior to opening a set of cage doors, reading a first position of the elevator cage, relative to the elevator shaft, from a travel transmitter;

upon issuance of a command to close the set of cage doors, reading a second position of the elevator cage, relative to the elevator shaft, from the travel transmitter;

evaluating the first signal based upon a difference between the first position and the second position.

9. The method according to claim 7, the second signal evaluating step comprising:

determining whether the set of cage doors is closed;

determining a motor current at a target speed of the elevator cage;

evaluating the second signal based upon the determined motor current.

10. The method according to claim 7, the method further comprising, after the transmitting step, replacing the evaluated third signal with a subsequently evaluated second signal.

11. The method according to claim 7, the method further comprising transmitting the evaluated third signal to an elevator control device.

12. The method according to claim 11, the method further comprising transmitting travel commands from the elevator control device to the motor control.

13. The method according to claim 12, the method further comprising determining, within the motor control, a travel curve based upon the travel commands and upon a travel signal indicative of a position of the elevator cage relative to the elevator shaft.

14. The method according to claim 7, wherein the first signal evaluating step is performed by a first converter.

15. The method according to claim 14, wherein the first converter comprises at least one of a look-up table and a mathematical formula.

16. The method according to claim 7, wherein the second signal evaluating step is performed by a second converter.

17. The method according to claim 16, wherein the second converter comprises at least one of a look-up table and a mathematical formula.

18. An apparatus for the measurement of a load in an elevator cage, the elevator cage mounted for movement relative to a carrying frame and to an elevator shaft and moved relative to the carrying frame and elevator shaft by load changes within the elevator cage, said apparatus comprising:

means for evaluating a first signal corresponding to the movement of the elevator cage relative to the elevator shaft;

means for evaluating a second signal corresponding to a cage load;

means for evaluating a third signal, based upon the first signal and the second signal;

means for transmitting the third signal to a motor control to control a motor current.

19. The apparatus according to claim 18, said first signal evaluating means comprising:

means for determining whether the elevator cage has arrived at a stopping place;

means for reading a first position of the elevator cage, relative to the elevator shaft, from a travel transmitter, prior to opening a set of cage doors;

means for reading a second position of the elevator cage, relative to the elevator shaft, from the travel transmitter, upon issuance of a command to close the set of cage doors;

said first signal based upon a difference between the first position and the second position.

20. The apparatus according to claim 18, said second signal evaluating means comprising:

means for determining whether the set of cage doors is closed;

means for determining a motor current at a target speed of the elevator cage;

means for evaluating the second signal based upon the determined motor current.

21. The apparatus according to claim 18, the apparatus further comprising means for replacing the evaluated third signal with a subsequently evaluated second signal after said third signal is transmitted to said motor control.

22. The apparatus according to claim 18, said first signal evaluating means comprising a converter.

23. The apparatus according to claim 18, said second signal evaluating means comprising a converter.

* * * * *